US006733169B2

(12) United States Patent
Steffen

(10) Patent No.: US 6,733,169 B2
(45) Date of Patent: May 11, 2004

(54) POKER VIBRATOR WITH FREQUENCY TRANSFORMER

(75) Inventor: Michael Steffen, Stockdorf (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/420,180

(22) Filed: Apr. 22, 2003

(65) Prior Publication Data

US 2003/0198123 A1 Oct. 23, 2003

Related U.S. Application Data

(63) Continuation of application No. 09/936,798, filed on Sep. 12, 2001, now Pat. No. 6,619,832.

(30) Foreign Application Priority Data

Mar. 24, 1999 (DE) ..... 199 13 305
Feb. 22, 2000 (WO) ..... PCT/EP00/01429

(51) Int. Cl.[7] ..... B01F 11/00
(52) U.S. Cl. ..... 366/120
(58) Field of Search ..... 366/116, 120–123, 366/128, 601

(56) References Cited

U.S. PATENT DOCUMENTS 2,808,238 A * 10/1957 Spitler ..... 366/123
2,966,804 A * 1/1961 McCarthy ..... 366/120
3,061,278 A * 10/1962 Dreyer ..... 366/122
3,410,528 A * 11/1968 Clark et al. ..... 366/123
3,466,014 A * 9/1969 Pottgens ..... 366/120
3,583,677 A * 6/1971 Phillips ..... 366/120
3,782,693 A * 1/1974 Strohbeck ..... 366/122
5,202,612 A * 4/1993 Yoshida et al. ..... 366/116
5,725,304 A * 3/1998 Inai ..... 366/120
6,084,327 A * 7/2000 Steffen
6,109,111 A * 8/2000 Heimbruch et al. ..... 366/123
6,619,832 B1 * 9/2003 Steffen ..... 366/120

FOREIGN PATENT DOCUMENTS

EP 0 604 723 * 7/1994
EP 0 916 785 * 5/1999

* cited by examiner

*Primary Examiner*—Charles E. Cooley
(74) *Attorney, Agent, or Firm*—Boyle Fredrickson Newholm Stein & Gratz S.C.

(57) ABSTRACT

The invention relates to a poker vibrator for compressing concrete. The poker vibrator comprises a vibrating housing that accommodates an unbalanced mass and an electromotor, an insulating plastic tube that links the vibrating housing to a switch cover, an electric cable that links the switch cover to a connector shell and that bears a power plug, and a frequency converter that supplies the current for the electromotor. The poker vibrator is characterized in that the switch is arranged separately from a coupling piece on the tube and not on the electric cable and/or in that at least some of the components of the frequency transformer are arranged in a transformer housing provided between the switch housing and the powerplug.

5 Claims, 3 Drawing Sheets

POKER VIBRATOR WITH FREQUENCY TRANSFORMER

CROSS REFERENCE TO A RELATED APPLICATION

This application is a continuation of and commonly assigned U.S. Pat. application Ser. No. 09/936,798, filed Sep. 12, 2001 now U.S. Pat. No. 6,619,832 B1 and entitled "Poker Vibrator with Frequency Transformer", the subject matter of which is hereby incorporated by reference in its entirety.

BACKGROUND OF THE INVENTION

Field of the Invention

This invention pertains to a poker vibrator.

Poker vibrators of this type are used to compress fresh concrete by attaching a vibrator body or housing to a protective tube. The vibrator body contains an eccentric weight rotated by an electric motor. In order to produce a compression frequency suitable for the fresh concrete, the motor must rotate with a very high rate of rotation, for example 12,000 RPM. This requires a higher electrical frequency compared to normal commercial power frequencies. To produce the increased electrical frequency, a frequency transformer is connected upstream of the electric motor, increasing the commercial power frequency from 50 Hertz to, for example, 200 Hertz.

There are poker vibrators wherein the protective tube is designed as an operating tube at the same time, having a length of a few meters. A switch housing is attached to the end of the protective tube opposite the vibrator housing. This switch housing contains a line switch. An electric cable runs from the switch housing to a plug that can be inserted into a conventional frequency transformer. The disadvantages in operating a poker vibrator of this kind, which are a consequence of the separate frequency transformer that is very cumbersome and difficult to handle, have resulted in the development of a poker vibrator that combines the frequency transformer with the switch in a miniaturized switch housing. This type of poker vibrator is described in EP 0 604 723 and has proven itself to be outstanding in practice. In particular, the device is very easy to operate since there is no longer a separate frequency transformer.

However, in order to integrate the frequency transformer into the switch housing, it was necessary to make the switch housing somewhat larger, which can be a disadvantage in pulling it around and with its portability at the construction site. In particular, it is possible for the somewhat enlarged switch housing to get caught on concrete reinforcement bars. Also, the switch housing with the integrated frequency transformer has a considerable weight so that constantly pulling the switch housing around can be difficult during work.

U.S. Pat. No. 5,202,612 portrays a poker vibrator that has an electric motor in a vibrator housing that is provided a power current through an electric power feed system. This current has an electrical frequency that deviates from the commercial power frequency. In the cable constituting the electric power feed system, there is first of all a switch and secondly a frequency transformer separately located from the switch.

In GB-A-2 279 184, a power plug is described with an integrated switch to interrupt the current feed.

DE 197 22 107 portrays a cable drum with an integrated frequency transformer. A power plug from a poker vibrator that requires a frequency produced from the frequency transformer can be inserted into an outlet in the cable drum.

OBJECTS AND SUMMARY OF THE INVENTION

The objective of this invention is to provide a poker vibrator that is even easier to handle, whose portability in particular is improved and whose weight that has to be moved around by the user is reduced.

The solution to this objective is provided by the poker vibrator of the present invention. Advantageous developments and embodiments of the invention can also be found in the following description.

A poker vibrator is characterized in that at least some of the components of the frequency transformer are located inside the vibrator housing or the plug housing. There are essentially two concepts of this embodiment form:

- All components of the frequency transformer are integrated into the vibrator housing;
- All components of the frequency transformer are integrated into the plug housing; or
- The components of the frequency transformer are built into different areas of the poker vibrator.

Numerous advantages arise from the above for the construction and operation of the poker vibrator. These will be explained in detail later in the description of the embodiment forms. The essential feature is that the frequency transformer is no longer integrated into the switch housing, resulting in the advantage that the housing is very light and "slippery", or can be slid again due to its low weight and small dimensions. In operating the poker vibrator, this results in the advantage that the switch housing can be pulled from behind when working with the operating tube.

Secondly, the arrangement of the frequency transformer's components at certain points in the poker vibrator offers the ability to install the components at targeted locations where it is especially beneficial for them to be kept. Thus, it is especially advantageous if a power component that produces a lot of heat during operation is kept in the vibrator housing that is dipped into the wet concrete, since in this way an especially effective cooling is possible.

It is not necessary that the invention variations have the switch located in its own switch housing. The switch can also be integrated into the plug housing, into the protective tube or into the vibrator housing.

The poker vibrator of the present invention also defines an embodiment form in which the frequency transformer and the switch are kept in different housings, namely in this case in a coupling and in a switch housing, respectively. This makes it possible to optimize the weight distribution at the poker vibrator and allows a shape for better portability. This can be done in a way that integrates the switch into the plug housing, whereas the frequency transformer is located in the coupling between the protective tube and the electric cable.

In another variation of the invention at least some of the components of the frequency transformer are located in a transformer housing provided between the switch housing and the power plug. This also makes it possible to optimize the weight distribution and external shape of the poker vibrator.

The invention also contemplates still another embodiment form in which at least some of the components of the frequency transformer are located in the protective tube and this portion of the components is not integrated into the switch housing. This makes it possible, for example for a poker vibrator from EP 0 604 723, to remove at least some of the components of the frequency transformer from the switch housing described there and to locate them at other points in the protective tube. This makes it possible for the switch housing to be shaped like a streamline, resulting in the improvement of the poker vibrator's sliding ability.

BRIEF DESCRIPTION OF THE DRAWINGS

This and other advantages and features are explained in more detail below with the help of examples and with the aid of the accompanying drawing figures.

The first figure shows a poker vibrator according to the invention in a perspective view.

Figure 1:
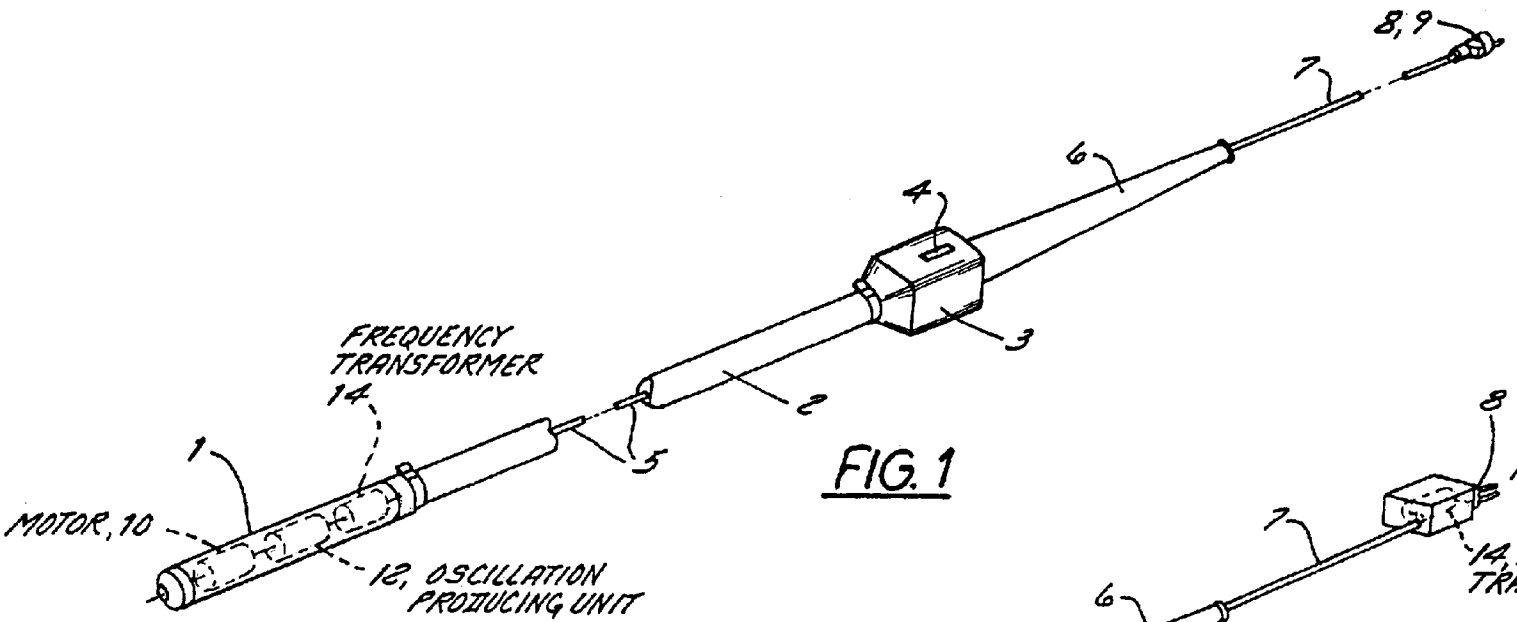

The second figure shows a second embodiment of the poker vibrator in a perspective view.

The third figure shows a third embodiment of the poker vibrator in a perspective view.

The fourth figure shows a fourth embodiment of the poker vibrator in a perspective view.

The fifth figure shows a fifth embodiment of the poker vibrator in a perspective view.

The sixth figure shows a sixth embodiment of the poker vibrator in a perspective view.

DETAILED DESCRIPTION OF THE PREFERRED EMBODIMENTS

In a vibrator housing 1, also called a vibrator flask, is an electric motor 10. This motor 10 drives an eccentric weight that rotates with a high rotational rate, serving as an oscillation-producing unit 12. The sets the vibrator housing 1, which is dipped into the still fluid concrete, into oscillatory motion, through which the desired compression effect is attained in the concrete.

The vibrator housing 1 is fastened to one side of a protective tube 2 that can be up to a number of meters (for example 6 meters) in length and can be held by the user during operation. Thus, the protective tube 2 can also be used as an operating tube.

A switch housing 3, also called the switchgear, is attached to the other end of the protective tube 2 and is used here as a coupling. The protective tube 2 therefore extends linearly from the vibratory housing 1 to the switch housing 3. This switch housing contains a switch 4. Electrical feed lines 5 to the electric motor 10 in the vibrator housing 1 can be connected or disconnected by means of the switch 4 in a known fashion. The electrical feed lines 5 run inside the protective tube 2.

A rubber grommet 6 extends from the other side of the switch housing 3. An electric cable 7 runs inside of it that terminates at a plug housing 9 with a plug 8. The function of the coupling (here: switch housing 3) is to couple the stable protective tube 2 to the electric cable 7.

As already explained, the electric motor 10 must rotate with very high revolutions and thus requires an electrical frequency to operate that is larger than the commercial power frequency. Common frequencies applied are in the 200-Hertz range, which corresponds to four times the commercial power frequency.

In order to attain the desired frequency, a process is known from the state of the technology to convert the supply current in a frequency transformer 14. It was first of all possible to attain this by inserting the plug 8 into a separate frequency transformer unit 14. Secondly, it is known that the switch housing 3 had to be enlarged in order to make space for the frequency transformer 14 next to the switch 4 there. Both embodiments have disadvantages, however, which are solved by this invention.

In a first embodiment form of the poker vibrator according to this invention and shown in FIG. 1, all components of the electronic hybrid frequency transformer 14 are integrated into the vibrator housing 1 and directly attached to the electric motor 10. The supply current is fed from the plug 8, through the electric cable 7, the switch 4 and the electric feed lines 5 to the vibrator housing 1. The electric cable 7 and the electric feed lines 5 form an electric feed from the plug 8 to the electric motor 10.

This embodiment form has the advantage in that the switch housing 3 assumes a very small, handy and portable form so that the operator can easily move it around the rebar when operating the poker vibrator. Moreover, the cooling element volume of the electronic frequency transformer 14 can be reduced greatly, since the vibrator housing 1 made of metal dissipates heat from the frequency transformer 14 and conveys it to the wet concrete, which guarantees very efficient cooling. Moreover, the protective tube 2 no longer has to be shielded since it only feeds supply current. Finally, the winding temperature of the motor 10 can be measured using a temperature sensor and read back as an operating parameter. By providing suitable controls, the frequency transformer 14 can be controlled according to this temperature.

Figure 2:
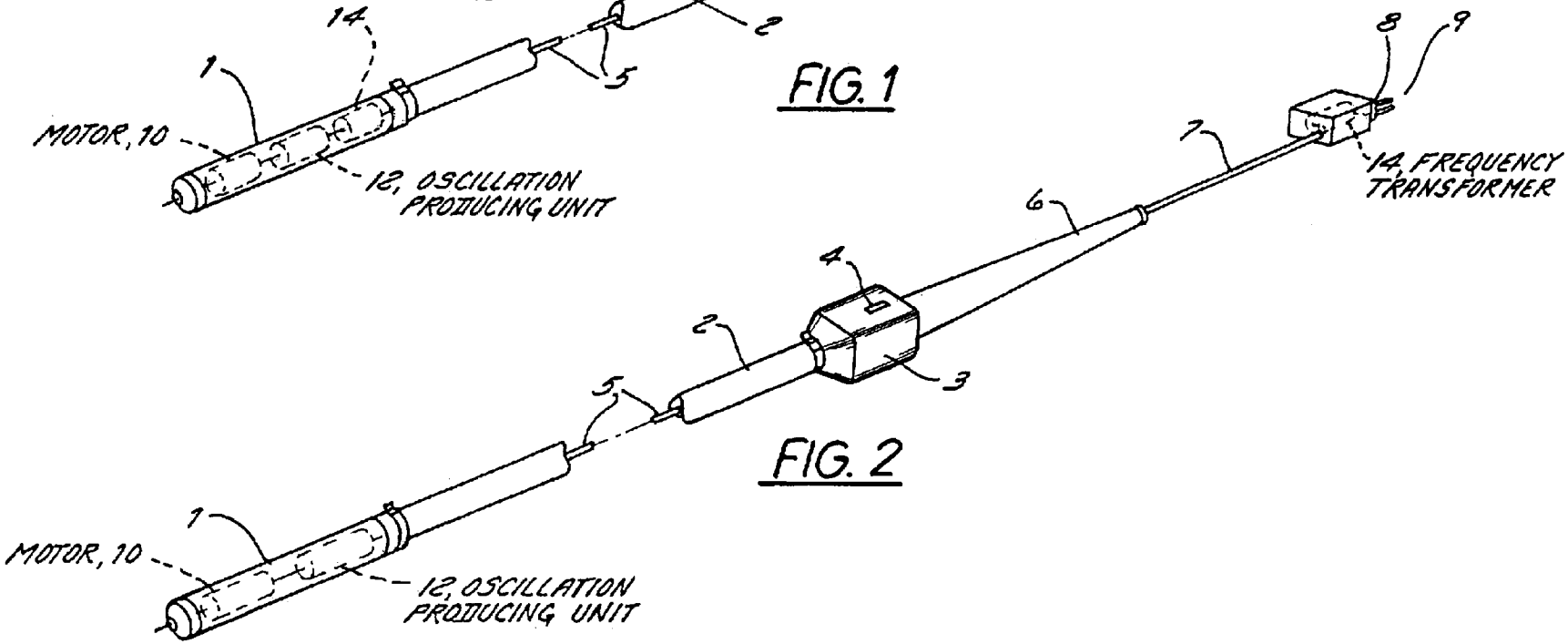

In a second embodiment form of the invention shown in FIG. 2, the frequency transformer 14 is completely integrated into the plug housing 9 containing the plug 8.

This variation requires an enlarged plug housing 9 compared to common plug housings, which, however, does not result in disadvantages for the operation of the poker vibrator since the plug 8 is usually inserted into a fixed cable drum or outlet. Thus, the operator only seldom has to lift and move the plug housing 9 with the integrated frequency transformer 14 when operating the poker vibrator.

The vibrator housing 1 and the switch housing 3 do not change in the process. Since now the increased frequency is already present beginning at the plug housing 9, the electric cable 7 and the electric feed lines 5 have to be shielded inside the protective tube 2. Since the frequency transformer 14 is cooled in the plug housing 9 essentially using air, this embodiment form is advantageously suitable for small poker vibrators with small power usage.

The integration of the frequency transformer 14 into the plug housing 9—for example by integrating it with a leakage current protection switch (FI-DI switch) (not shown)—provides for an especially high operational safety. In addition, it is possible to monitor the vibrator housing 1 containing the electric motor 10, the frequency transformer 14, the protective tube 2 and the electric cable 7 for short circuits, grounding, and leakage current using suitable electronics at the frequency transformer 14. This protects these components. If the protective tube 2 with the feed lines 5 or the electric cable 7 is damaged, the power feed to the poker vibrator is interrupted immediately.

Figure 3:
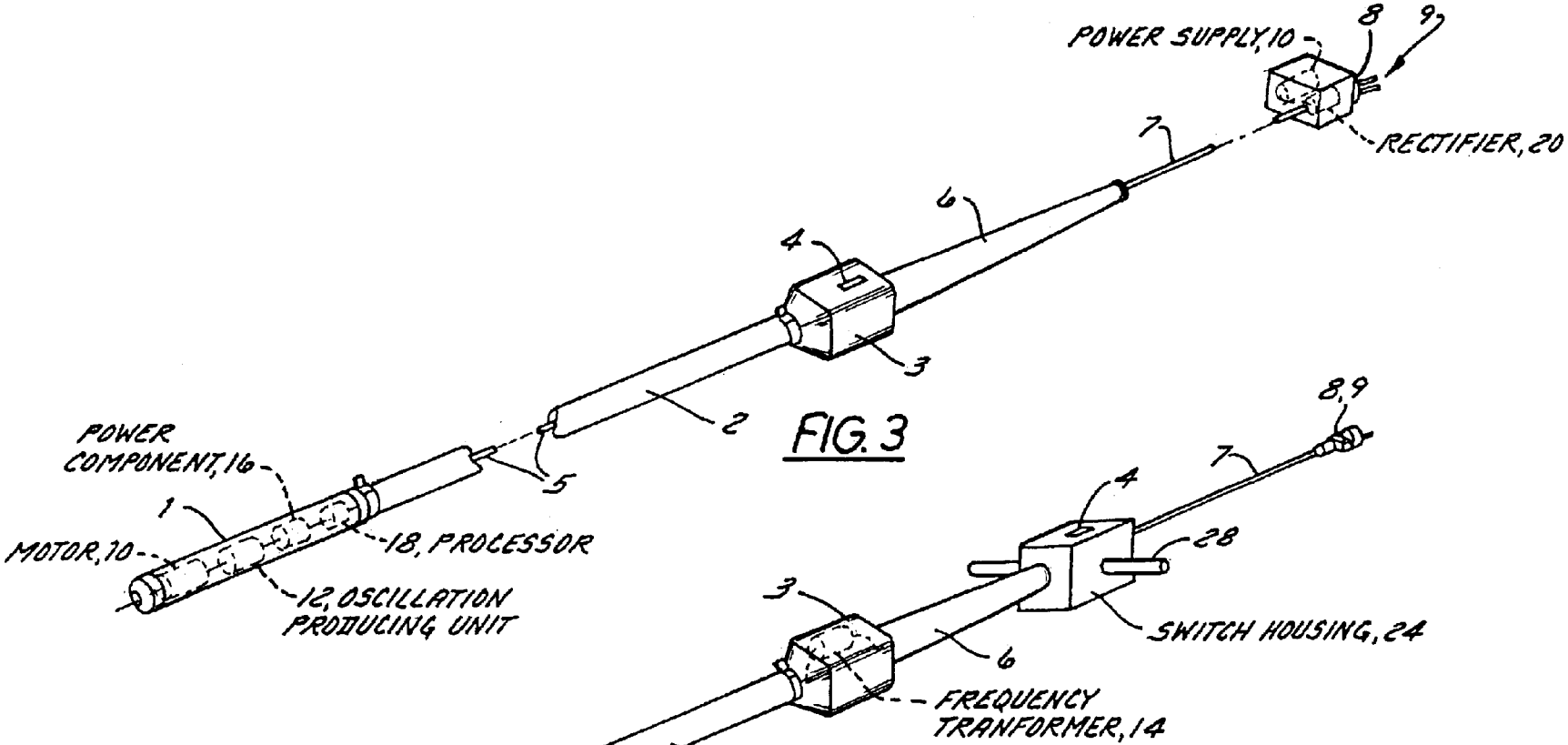

In the third embodiment form of the invention shown in FIG. 3, the components of the frequency transformer 14 are distributed in the poker vibrator according to what is best suitable if the frequency transformer 14 consists of a number of components. This means that a power component 16 and a processor 18 in the frequency transformer 14 are built into the vibrator housing 1, resulting in optimum cooling by the wet concrete and with the vibrator housing 1 serving as the cooling body. The frequency transformer's rectifier 20 and a switching power supply 22 are integrated into the plug housing 9. Any required capacitors, in particular DC intermediate circuit capacitors, can be integrated into the poker vibrator's protective tube 2.

This type of distributed design enables minimal volumes and thus minimal weight of the poker vibrator. The switch housing 3, which as before only contains the switch 4, remains small and portable. Through the cooling effect of the vibrator flask 1, additional cooling element volumes can be eliminated. By producing the higher frequency in the vibrator housing 1 itself, the protective tube 2 and the electric cable 7 do not have to be shielded.

Figure 4:
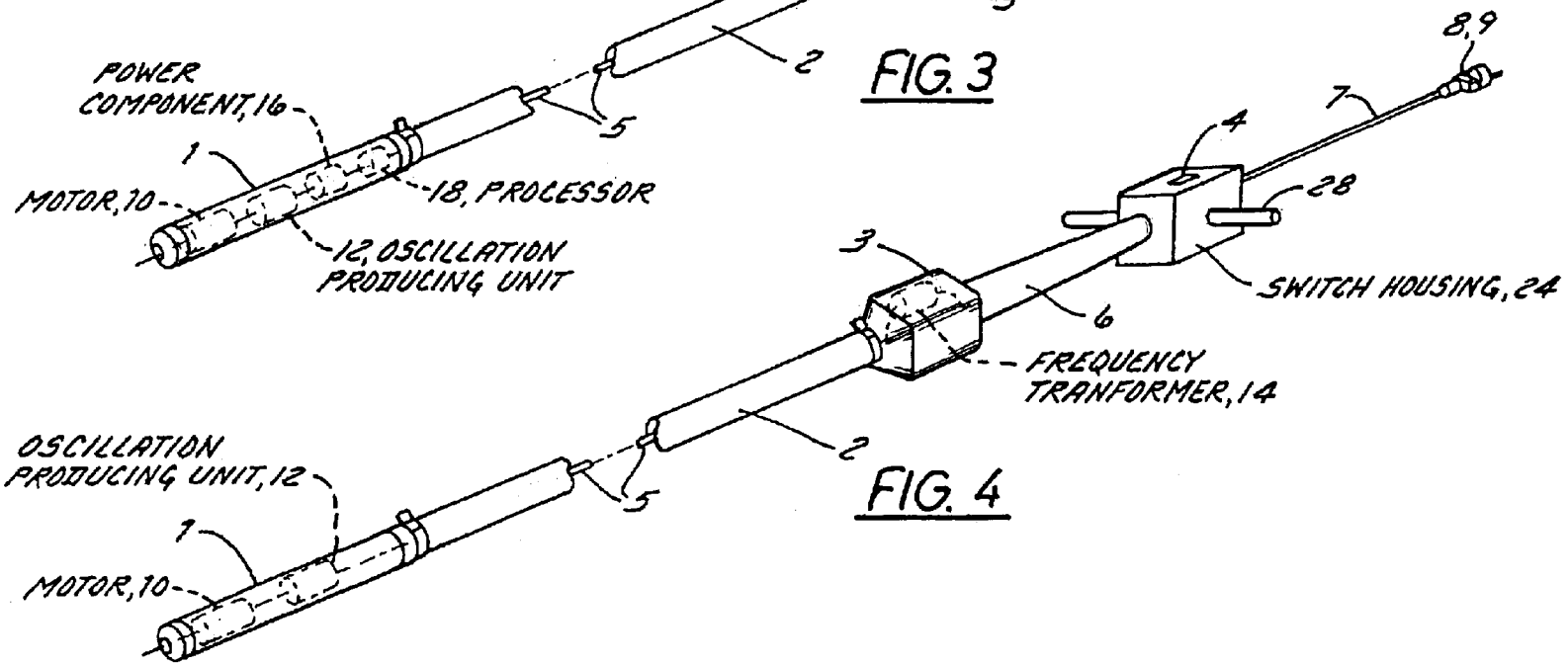

A fourth embodiment example of the invention, which is shown in FIG. 4, is characterized in that the frequency transformer 14 is located in the coupling 3 between the protective tube and the electric cable, but a separate secondary switch housing 24 containing the switch 4 is located separately from the coupling 3. This variation makes possible numerous different configurations to optimize the weight distribution and portability.

Figure 5:
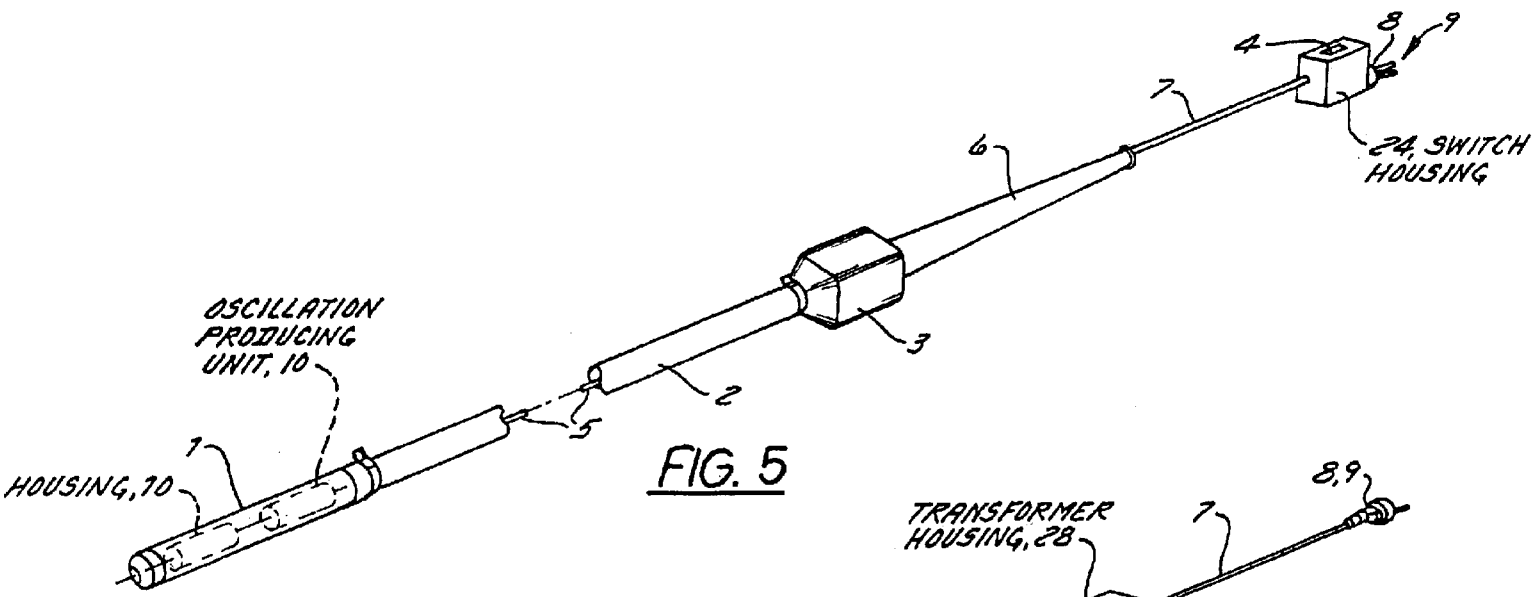

In a fifth embodiment form of the invention, shown in FIG. 5, the fourth embodiment form is further developed such that the secondary switch housing 24 is integrated into the plug housing 9.

Figure 6:
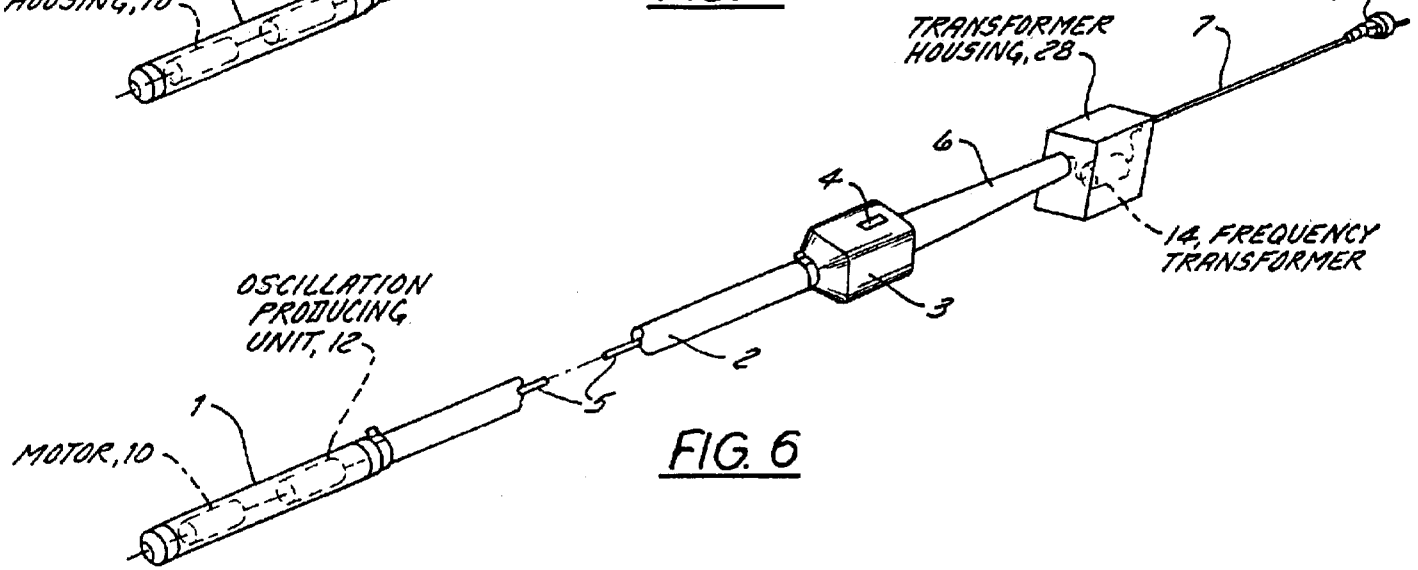

A sixth embodiment form, which is shown in FIG. 6, is characterized in that at least some of the components of the frequency transformer 14 are located in a transformer housing 28 provided between the switch housing 3 and the power plug 8. This is another way to spatially separate the frequency transformer 14 and the switch housing 3 from one another so as to obtain the advantageous configurational possibilities.

The variations described are also suitable for poker vibrators with short protective tubes, for example a rod or wand-type vibrator. In these types of vibrators, the operation is not done using the protective tube, but by means of a hand grip 26 that for example is combined with the secondary switch housing 24 as shown in FIG. 4.

Other possible variations for the application of the invention are the integration of the switch into the protective tube. Likewise, the coupling fastened to the end of the protective tube 2 can be eliminated if a switch or a frequency transformer does not have to be kept there. Instead, the end of the protective tube 2 can feed out through a grommet that is similar to rubber grommet 6 and can flow into the electric cable 7. Likewise, it is possible to vulcanize the end of the protective tube 2 such that it transitions into the electric cable 7. By integrating both the switch and the frequency transformer into the plug housing 9, the protective tube 2 or the vibrator housing 1 at the same time, a poker vibrator with smooth exterior contours without bulges can be created that exhibits excellent slip accordingly.

I claim:

1. A poker vibrator for compacting concrete, comprising:

a vibrator housing receiving an oscillation-producing unit and an electric motor that drives the oscillation-producing unit;

a protective and operating tube that is fastened to the vibrator housing at one end of the tube;

a coupling piece is fastened to the protective and operating tube at the other end of the tube;

an electric cable that connects the coupling piece to a plug housing bearing a power plug and belonging to an electric feed to the electric motor;

a switch arranged in the electric feed from the power plug to the electric motor; and a frequency transformer, that feeds the electric motor, that can be electrically coupled to the power plug, that is arranged in the coupling piece, and that comprises one or more components, for generating an electrical frequency that deviates from a power-line frequency, wherein the switch is arranged separately from the coupling piece and not on the electric cable.

2. The poker vibrator as recited in claim 1, wherein the switch is mounted on a switch housing attached to an end of the protective and operating tube opposite the one end.

3. The poker vibrator as recited in claim 1, wherein at some components of the frequency transformer are arranged in a transformer housing located between the switch and the power plug.

4. A poker vibrator for compacting concrete, comprising:

a vibrator housing that contains an oscillation-producing unit and an electric motor that drives the oscillation-producing unit;

a protective and operating tube that extends linearly from the vibrator housing to a switch housing that bears a switch;

an electric cable that is electrically connected to the switch housing and that leads to a power plug; and a frequency transformer that feeds the electric motor, that can be electrically coupled to the power plug, and that is made of one or more components, for generating an electrical frequency that deviates from a power-line frequency;

wherein at least some of the components of the frequency transformer are arranged in a transformer housing provided between the switch housing and the power plug and the switch is not disposed on the electric cable.

5. The poker vibrator as recited in claim 4, wherein the frequency transformer includes at least one component from the group consisting of a switched-mode power supply, a rectifier, a direct-current capacitor, a power circuit, a processor, and a cooling circuit.

* * * * *